US005497529A

United States Patent [19]

Boesi

[11] Patent Number: 5,497,529

[45] Date of Patent: Mar. 12, 1996

[54] ELECTRICAL APPARATUS FOR CLEANING SURFACES BY SUCTION IN DWELLING PREMISES

[76] Inventor: Anna M. Boesi, Via Lesbia Cidonia 4/A, 24124 Bergamo (Bergamo), Italy

[21] Appl. No.: 274,496

[22] Filed: Jul. 13, 1994

[30] Foreign Application Priority Data

Jul. 20, 1993 [IT] Italy ..... MI93A1591

[51] Int. Cl.[6] ..... A47L 9/28

[52] U.S. Cl. ..... 15/319; 15/340.3; 15/412; 180/7.1

[58] Field of Search ..... 15/319, 339, 340.1, 15/340.2, 340.3, 324, 366, 412; 446/465, 454, 456, 460, 468, 469; 180/7.2, 7.1

[56] References Cited

U.S. PATENT DOCUMENTS

| | | | |
|---|---|---|---|
| 3,746,112 | 7/1973 | Ilon | 180/7.2 |
| 3,753,265 | 8/1973 | Wulc | 15/319 |
| 4,306,329 | 12/1981 | Yokoi | 15/319 |
| 4,369,543 | 1/1983 | Chen et al. | 15/319 |
| 4,513,469 | 4/1985 | Godfrey et al. | 15/319 |
| 4,744,781 | 5/1988 | Ostendorff et al. | 446/465 |
| 5,109,566 | 5/1992 | Kobayashi et al. | 15/340.1 |
| 5,341,540 | 8/1994 | Soupert et al. | 15/319 |

FOREIGN PATENT DOCUMENTS

| | | | |
|---|---|---|---|
| 2907272 | 8/1980 | Germany | 180/7.1 |
| 149270 | 6/1988 | Japan | 180/7.1 |
| 279081 | 12/1991 | Japan | 180/7.2 |
| 197232 | 7/1992 | Japan | 15/324 |
| 105781 | 4/1994 | Japan | 15/319 |
| 03132 | 6/1986 | WIPO | 180/7.1 |
| 14788 | 12/1990 | WIPO . | |

*Primary Examiner*—David Scherbel
*Assistant Examiner*—Tony G. Soohoo
*Attorney, Agent, or Firm*—Laff, Whitesel, Conte & Saret, Ltd.

[57] ABSTRACT

The described apparatus comprises a suction unit (2) detachably mounted on a support platform (12) provided with four wheels (37) to be operated independently by corresponding movement motors (36). The movement motors (36) are governed by an electronic control unit (35), driven by a receive unit (33) based on radio pulses (32*a*) transmitted by a transmit unit (32) operable manually by an operator. The suction unit (2) can be disengaged from the support platform (12) and associated with an auxiliary handgrip (53) for manual use.

15 Claims, 4 Drawing Sheets

FIG3
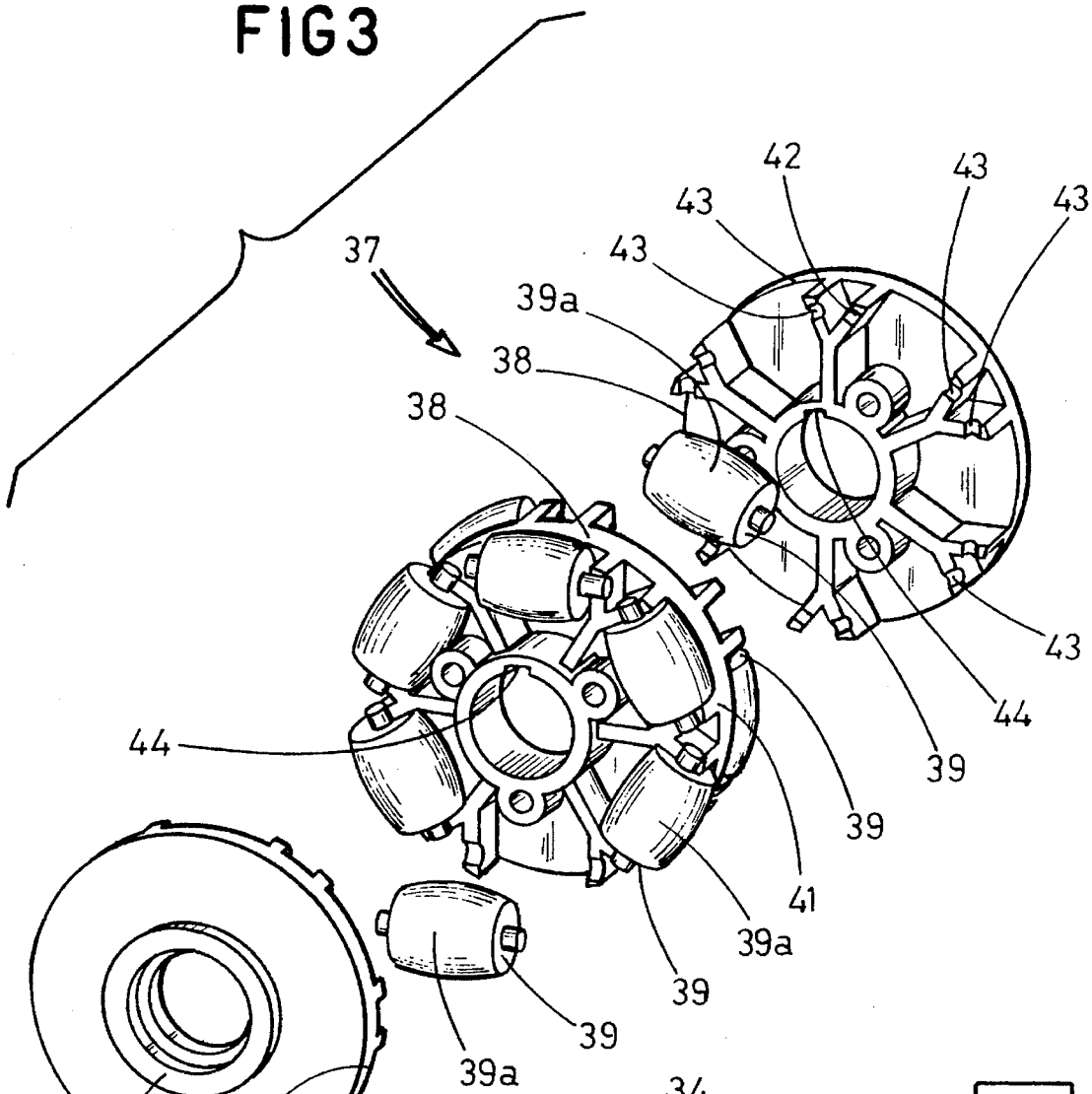
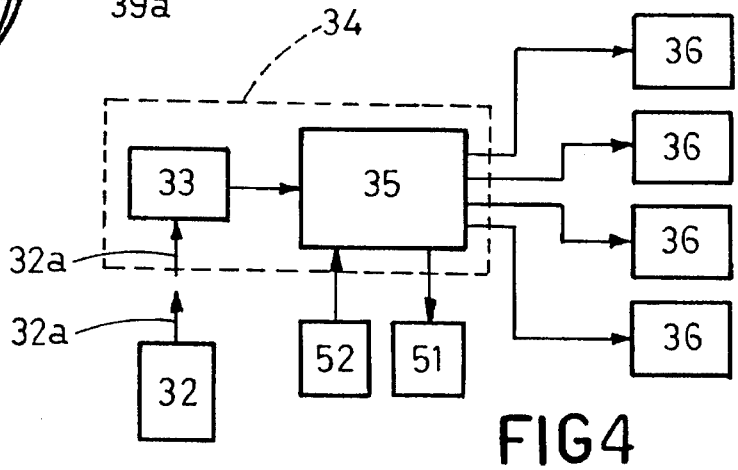
FIG4

ELECTRICAL APPARATUS FOR CLEANING SURFACES BY SUCTION IN DWELLING PREMISES

BACKGROUND OF THE INVENTION

1. Field of the Invention

The present invention relates to an electrical apparatus for cleaning surfaces by suction, of the type comprising a suction unit having a casing within which at least one fan is operatively housed, which fan is operated by at least one electric driving motor for producing an air stream admitted through at least one suction opening exhibited frontally by the casing and emitted through delivery slits located on the casing itself; a collection container for receiving the drawn in material, which is removably engaged to the casing of the suction unit substantially in a sealing manner about said suction opening and is provided with an inlet that opens onto the opposite side with respect to the casing; at least one filtering element operatively interposed between said suction opening and the collection container, for holding at the inside of said container the solid matter taken in through said inlet; at least one storage battery for powering said electric driving motor.

The apparatus in question is especially conceived for carrying out cleaning operations on floors, fitted carpets and carpets in dwelling premises, business premises and the like.

2. Prior Art

It is known that there are currently many types of surface-cleaning apparatus, such as vacuum-cleaners, electric brooms or the like that are adapted to collect dust and other particles laid down on said surfaces by a suction effect produced upon the action of a fan.

In more detail, there are many vacuum-cleaners in which the fan operated by a motor powered through the mains, draws air from a collection container defined with in the vacuum-cleaner structure or, in other cases, consisting of a bag made of a porous material and suitably housed in a chamber formed in said structure.

One end of a flexible wrinkled pipe opens into the collection container, the other pipe end being connected, upon interposition of handgrips and/or tubular extensions of the stiff type, to a brush or other appliance exhibiting an inlet through which, upon the action of the air stream produced by the fan, the material laying on the surface to be cleaned is sucked and conveyed to the collection container.

There are also electric brooms exhibiting a handle provided with a handgrip to which the casing housing the fan and the corresponding driving motor is directly connected, said driving motor being powered by storage batteries of the rechargeable type accommodated in the casing. The fan carries out suction of the air through an inlet that, upon interposition of a filtering element, communicates with the inside of a collection container. Opening into said container is a suction duct connected to a brush designed to act on the surface to be cleaned.

The foregoing being stated, it will be noted that any known type of vacuum cleaner, electric broom or other suction apparatus involves problems in terms of efficiency and practical use essentially due to the fact that a manual action is required on the part of the operator for pushing and dragging along the brush or other accessory designed to collect dust by suction, over the surface to be cleaned. In this respect it will be also recognized that in order to enable an operator to control the movements of the brush while he is standing, the brush must be connected to the handgrip by interposition of a stiff pipe or other stiff element of appropriate length. This situation brings about other problems when the surfaces to be cleaned are hardly accessible being for example located under a bed or a piece of furniture, which happens rather often. In all the above case, the presence of the stiff connecting elements between the brush and the handgrip, and the necessity of exerting a manual action for moving the brush makes the cleaning operation still more difficult and sometimes even impossible.

SUMMARY OF THE INVENTION

The main object of the present invention is substantially to solve the problems of the known art, by providing a suction apparatus enabling cleaning to be carried out in a very easy manner even in places that can be hardly reached, by eliminating the necessity for the user to directly contact the apparatus itself.

The foregoing and further objects that will become more apparent in the course of the present description, are substantially achieved by an electrical apparatus for cleaning surfaces by suction, comprising: a support and movement platform carrying said suction unit; power-driven movement means for moving the support platform and suction unit over a surface to be cleaned; remote control means comprising a transmit unit to be activated manually for sending drive signals, and at least one receive unit operatively installed on the support platform for operating said movement means upon receipt of said drive signals.

BRIEF DESCRIPTION OF THE DRAWINGS

Further features and advantages will become more apparent from the detailed description of a preferred embodiment of an electrical apparatus for cleaning surfaces by suction in accordance with the present invention, given hereinafter by way of non-limiting example with reference to the accompanying drawings, in which:

FIG. 3 is an exploded perspective view to an enlarged scale of one of the wheels associated with the apparatus in question;

FIG. 4 is a block diagram of the electric components associated with the apparatus;

DESCRIPTION OF THE PREFERRED EMBODIMENT

Figure 1:
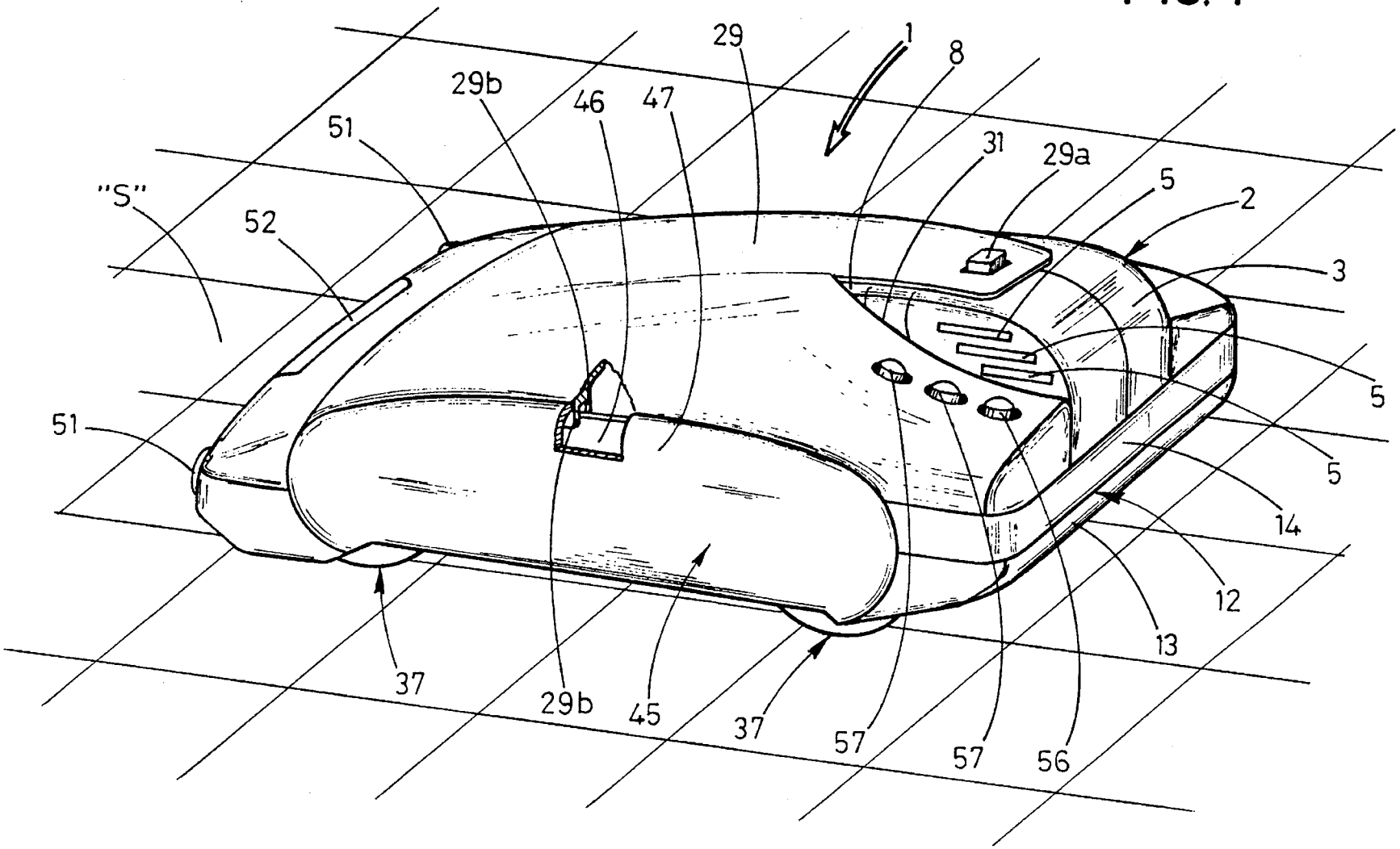
FIG. 1 is a perspective view of the apparatus of the invention.

Referring to the drawings, an electrical apparatus for cleaning surfaces by suction in accordance with the present invention has been generally identified by reference numeral 1.

The apparatus 1 comprises a suction unit 2 that, in known manner, has a casing 3 provided with a suction opening 4 at the front and one or more delivery slits 5 at the rear. Located within the casing 3 is at least one fan 6 operated by at least one electric driving motor 7 for producing an air stream entering the casing through the suction opening 4 and going out through the delivery slits 5.

Removably associated with the casing 3 is least one collection container 8 that, with the aid of hooking means 8*a* for example, is sealingly engaged at its one side about the suction opening 4. On a second side opposite with respect to the casing 3 the collection container 8 has an inlet 9 communicating with the surrounding atmosphere. Extending from the inlet 9 towards the inside of the collection container 8 is a suction channel 10 carrying a flexible closure diaphragm 10*a* at the end thereof.

Still in a manner known per se, at least one filtering element 11 is operatively interposed between the suction opening 4 of the casing 3 and the collection container 8, which filtering element is adapted to retain within the container the solid particles drawn in through the inlet 9.

In accordance with the present invention, the suction unit 2 is mounted, preferably in a removable manner, on a support and movement platform 12.

Such a support platform 12 is preferentially comprised of a base portion 13 and a closure portion 14 disposed upon the base portion and engaged thereto by coupling means and/or threaded elements for example, not shown as known per se and not of importance to the ends of the invention.

Close to the respectively opposite sides of the support platform 12, two hollow spaces 15 are defined between the base portion 13 and the closure portion 14, and received in said spaces are respective storage batteries 16 for powering the driving motor 7 of the suction unit of, as well as other electric components of the apparatus 1, to be described later.

Preferentially, the electric connection between the storage batteries 16 and driving motor 7 is achieved by at least first and second contact elements 17*a*, 17*b* disposed on the casing 3 of the suction unit 2 and the closure portion 14 of the support platform 12, respectively. Such contact element, 17*a*, 17*b* are designed to operatively engage with each other when the suction unit 2 is fitted in a correct manner in a corresponding first seat 18 defined in the closure portion 14.

The first seat 18 has a front wall 19 provided with an interconnecting aperture 20 at which the inlet 9 of the suction unit 2 is expose. Such interconnecting aperture is located at the end of a connecting duct 21 defined between one sloping wall 22 exhibited at the front of the base portion 13 of the support platform 12 and a second sloping wall 23 extending from a support element 24 engaged between the base portion 13 and the closure portion 14.

The support element 24, of substantially semicircular hollow configuration, operatively engages a rotating brush 25 at the inside thereof, which brush is operated, by means of a positive drive belt 26 upon command of an auxiliary motor 27 fastened to the front of tine closure portion 14 of the support platform 12. The rotating brush 25 acts on a surface to be cleaned "S" and over which the whole apparatus 1 rests, through a front suction slit 28 opening along the front lower side of the base portion 13 of the support platform 12 and being connected to the connecting duct 21.

A closure cover 29 hinged to the front of the support platform 12 and more particularly to support brackets 30 exhibited by the closure portion 14 lends itself to be shifted between an open condition in which the suction unit 2 is manually accessible for removal from and new fitting into the first seat 18, to a closed condition in which the cover is disposed at least partly over the suction unit on in order to fix the positioning of said unit on the platform 12. The cover 29 can be locked to the closed condition by one or more hooking elements 29*a* acting on the suction unit 2 and/or the platform 12.

Preferably, the cover 29 in the closed condition defines, together with the platform 12, a rear aperture 31 from which the casing 3 of the suction unit 2, or at least the delivery slits 5 provided thereon, are exposed.

In an original manner, associated with the apparatus 1 is control means 32, 33 acting on power-driven movement means 36, 37 for selectively causing forward and backward movements and stopping and steering actions of the support platform 12 and the suction unit 2 an the surface "S" to be cleaned.

Advantageously, such control means, of the remote type, comprises a transmit unit 32 only diagrammatically shown in the accompanying figures, which lends itself to be manually operated by the user for sending drive signals 32*a*, for example radio signals or infrared signals. The transmit unit 32 may be made for example in the form of a common remote control provided for example with four pushbuttons which may be selectively activated for respectively causing forward and reverse running a right-hand steering left-hand steering and stopping of the apparatus.

Combined with the transmit unit 32 is a receive unit 33 operatively mounted on the platform 12 and designed to operate said movement means 36, 37 following reception of the above specified drive signals.

Figure 2:
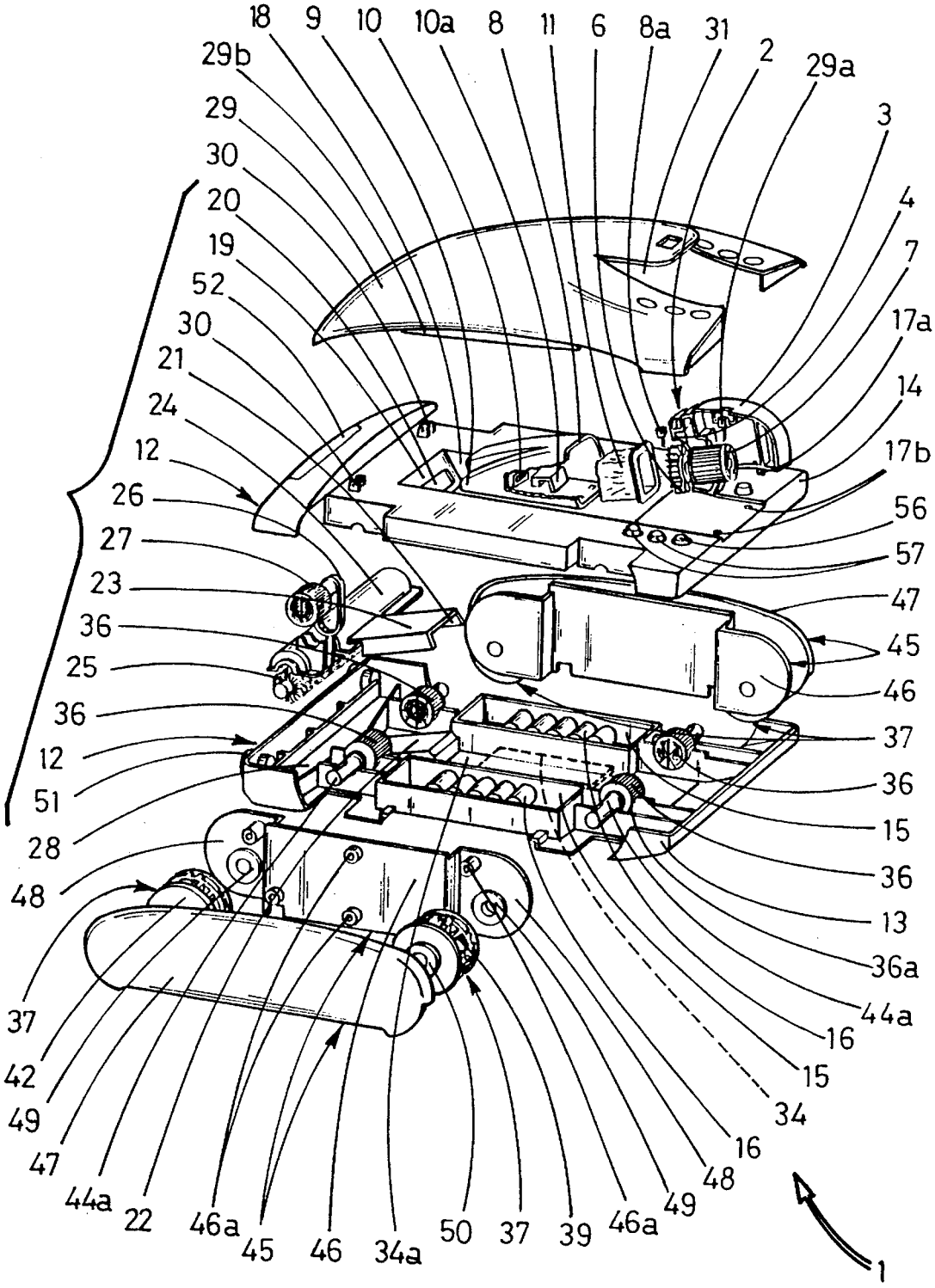
FIG. 2 is an exploded perspective view of the apparatus shown in FIG. 1.
Figure 5:
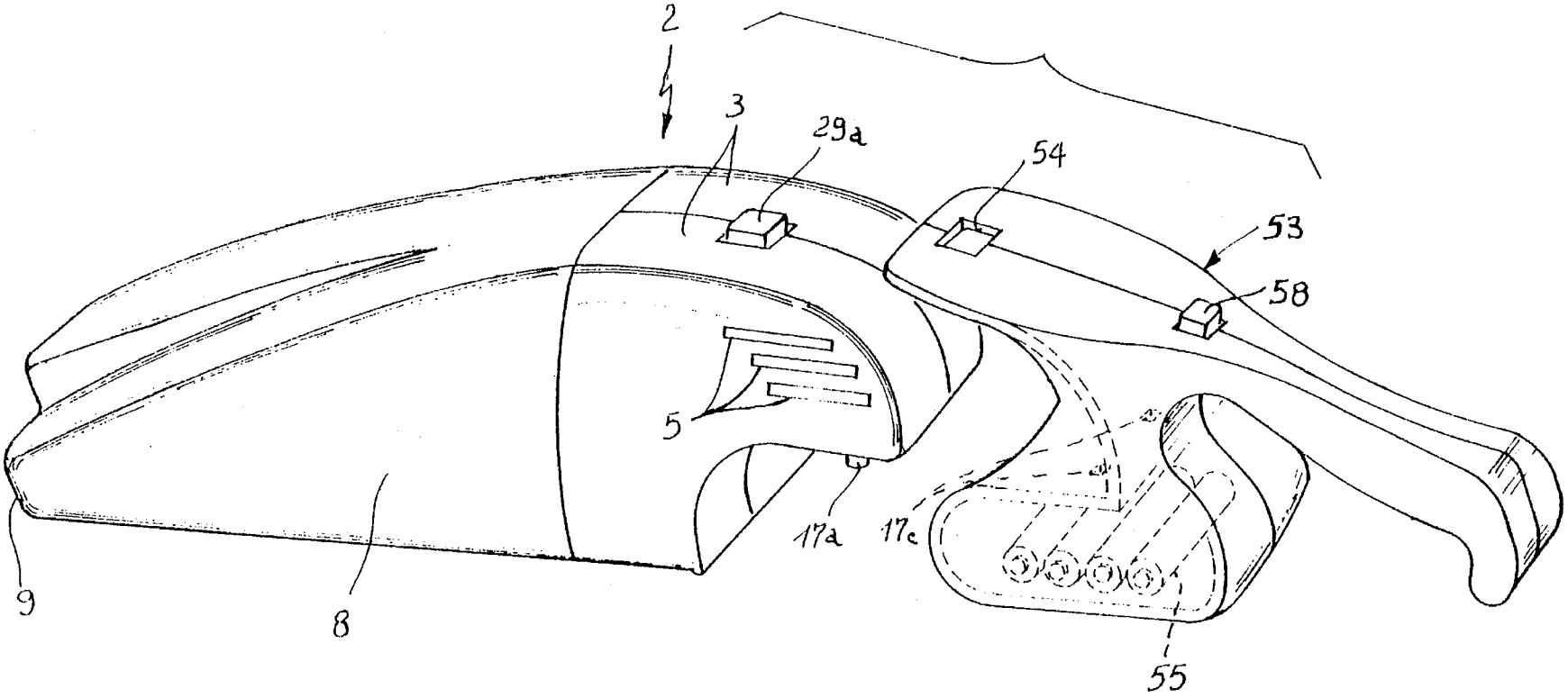
FIG. 5 is a partly exploded perspective view of the suction unit provided in the apparatus of the invention, associated with an auxiliary handgrip.

Said receive unit 33 can be directly embodied on a printed circuit board generally denoted by 34 in FIGS. 2 and 4 located in a corresponding housing 34*a*defined between the base portion 13 and closure portion 14 of platform 12.

The power-driven movement means preferably comprises four electric movement motors 36 engaged in corresponding seats 36*a* defined between the base portion 13 and closure portion 14 of the platform 12. Each of the movement motors 36 is operatively connected, possibly upon interposition of a reduction gearing not described as known per se and conventional, to a corresponding wheel 37 rotatably connected to the platform 12 and acting on the surface "S" to be cleaned on which it rests.

. The movement motors 36 are selectively operable based on the drive signals detected by the receive unit 33, through an electronic control unit 35 which may be located on the same board 34 carrying the receive unit 33 itself.

The movement motors 36 drive the corresponding wheels 37 in rotation in either way depending on the commands sent to the receive unit 34 by the transmit unit 33. In greater detail, when forward running is commanded, all of the four wheels 37 are driven in rotation counterclockwise with reference to FIG. 1. On the contrary, a reverse running of the apparatus involves a simultaneous operation of the four wheels 37 clockwise.

The steering movements to the right or to the left are achieved by causing the pairs of wheels 37 belonging to each of the platform sides to rotate in respectively opposite directions. More particularly, when a steering to the right is involved, the two wheels 37 disposed on the left side of the platform 12, that is the side visible in FIG. 1, rotate counterclockwise, whereas the wheels 37 disposed on the other side rotate clockwise. On the contrary, a steering to the left makes the wheels 37 on the left side rotate clockwise and the wheels 37 on the right side restate counterclockwise.

It is therefore apparent that adopting four movement motors 36 driving the respective wheels 37 in rotation independently of one another enables the desired running and steering movements to be achieved in a very simple manner without particular linkage and/or interconnecting mechanisms between the wheels being required. It is also to be noted that operation of the wheels 37 in opposite rotation directions enables steering radii practically of zero value or at all events very reduced values to be obtained. In fact the platform 12 can practically rotate about a vertical axis passing close to the platform center.

Advantageously, in order to eliminate any rubbing effect of the individual wheels 37 on the surface "S" to be cleaned, in particular during a steering action: each of the wheels 37 comprises a disc-shaped support body 38 to which a plurality of rollers 39 is connected , which rollers are distributed circumferentially according to a given pitch about the rotation axis of the wheel itself. More particularly, the rollers 39 are rotatably engaged with the disc-shaped body 38 according to respective rotation axes oriented tangentially of a common circumference concentric with the disc-shaped body itself and are adapted to act by contact on the surface "S" to be cleaned by respective rolling surfaces 39*a* advantageously exhibiting a curved profile having a bending radius equal to the distance between the rotation axis and the outer circumferential edge of the wheel 37 defined by the rolling surfaces themselves. It is also provided that the rollers 39 of each wheel 37 be distributed in at least two parallel circumferential rows disposed in side by side relation and such arranged that the rollers 39 belonging to each row are circumferentially offset by half a pitch with respect to the rollers of the adjacent row. By virtue of this expedient, the rolling surfaces 39*a* of rollers 39 come immediately one after the other circumferentially thereby defining a continuous circumference on the external perimetric edge of the wheel 37. Therefore while the wheel 37 is rotating the rollers 39 come successively in contact with the surface "S" to be cleaned without causing vibrations or jerks in the apparatus 1.

In addition, rollers 39 can freely rotate about the respective geometrical axes in order not to give rise to undesired rubbing effects on the surface "S" to be cleaned, as a result of side shiftings of the front and/or rear portion of the apparatus 1, inevitably produced during the steering steps.

The disc-shaped support body 38 of each wheel 37 is preferably comprised of a central portion 41 to be coupled, at laterally opposite parts thereof, with respective side portions 42. Pivot seatings 43 for the corresponding rollers 39 are defined between the central portion 41 and each of the side portions 42. In the central portion 41 and/or side portions 42 at least one coupling groove 44 is provided for operatively mounting the disc-shaped support body 38 to a corresponding splined shaft 44*a*of the respective movement motor 36.

Advantageously, the wheels 37 are also interconnected to the platform 12 by a pair- of box-shaped support elements 45, each of which houses two of said wheels 37 and is removably engaged, for example by restrained fixing, on one of the opposite sides of the platform 12. More particularly, each of the box-shaped support elements 45 comprises first and second plate-like elements 46, 47, to be removably coupled by restrained fixing, with the aid of fitting pawls 46*a* designed to be snap-fitted into corresponding, seatings, not shown in the figures, for engaging the corresponding wheels 37 in housing spaces 48 defined between the plate-like elements themselves. Each plate-like element 46, 47 is also provided with engagement seats 49 designed to rotatably house corresponding collar portions 50 projecting outwardly from the side portions 42 of the wheels 37, so that said wheels are rotatably engaged between said plate-like elements.

Advantageously, by disengaging the box-shaped support elements 45 from the platform 12 and separating the respective plate-like elements 46, 47, it is possible to remove the individual wheels 37 in order to carry out servicing and/or cleaning operations, when necessary.

At least one of the plate-like elements 46, 47 may advantageously have an upper edge operatively engaged by seal ribs 29*b* laterally exhibited by the closure cover 297 so as to prevent the occurrence of any accidental disengagement of the box-shaped support elements 45 from the platform 12 while the apparatus is being used.

In accordance with a further feature of the present invention, one or more lighting units 51 are provided at the front of the platform 12: they are designed to lighten the surface "S" to be cleaned ahead of the apparatus itself. Such lighting units 51 are fed by the electronic control unit 35, upon command of a photoelectric sensor 52 exposed externally of the apparatus 1. Such a photoelectric sensor 52 causes turning on of the lighting units 51 when the external brightness goes under a predetermined limit. Thus the apparatus can be better governed by the user when cleaning takes place in badly-lit places.

Advantageously, also associated with the apparatus 1 is at least one auxiliary handgrip 53 which can be detachably mounted, for example by means of a coupling opening 54 cooperating with said hooking element 29*a*, on the casing 3 of the suction unit 2 after said unit has been disengaged from the platform 12. Said auxiliary handgrip 53 makes it possible to utilize the suction unit 2 manually, for carrying out for example cleaning of armchairs and sofas and for other particular uses.

Advantageously, the auxiliary handgrip 53 houses auxiliary storage batteries 55 adapted to power the driving motor 7, by means of one or more third contact elements 17*c* operatively engaging with said first contact elements 17*a* on fitting of the auxiliary handgrip 53 on the casing 3.

After describing the apparatus mainly as regards its structure, operation and modalities of use of the same appear very simple.

When the suction unit is operatively engaged on the platform 12, switching on of the apparatus 1 may for example take place by a main switch 56 and one or more auxiliary switches 57 appearing at the upper part of the platform and designed to control the electric supply to the printed circuit board 34, the driving motor 7 associated with the fan, and the auxiliary motor 27 associated with the rotating brush 25. The movement motors 36 in turn are operated by the electronic control unit 35 upon command of the receive unit 33, receiving the drive signals a from the transmit unit to operated by the user.

Upon direct control by the operator by means of the transmit unit 32, the apparatus 1 can be therefore easily guided on the surface "S" to be cleaned, even in places that are hardly or not accessible to traditional suction apparatus.

When the suction unit 2 is to be used manually, it is sufficient to lift the closure cover 29 in order to accede to the suction unit and remove it from the platform 12. The suction unit lends itself to be therefore coupled to the auxiliary handgrip 53 the auxiliary storage batteries 55 of which will feed the driving motor 7 upon command of a corresponding switch 58.

The present invention achieves the intended purposes.

The apparatus in question in fact eliminates all limits present when known suction apparatus are used, thereby enabling an easy cleaning also of those surfaces that are of difficult or impossible access.

The cleaning operations at said hardly accessible places are further facilitated by the fact that the apparatus can change its running direction executing steerings the radius of which is substantially zero. Practically, with the apparatus of the invention a steering operation needs a, space corresponding to a circumference circumscribing the support and movement platform 12.

It is also to be noted that the movement means, due to the expedients adopted in making them, allows the apparatus 1 to carry out forward, reverse and steering movements while leaving a wide space in the central region of the platform 12 for an easy installation of the suction unit 2. In addition the apparatus manufacture does not involve high costs.

It is understood than modifications and variations may be made to the apparatus as conceived without departing from the scope of the invention as defined by the claims.

What is claimed is:

1. An electrical apparatus for cleaning surfaces by suction, in dwelling promises comprising a suction unit having:

a casing exhibiting at least one frontal section opening and delivery slits;

at least one fan operatively housed in the casing;

at last one electric driving motor for driving the fan, whereby an air stream admitted through the frontal suction opening and emitted through the delivery slits is produced;

a collection container for receiving drawn-in material, which is removably engaged, at its one side, to the casing of the suction unit substantially in a sealing manner about said suction opening and is provided with an inlet opening onto a second side opposite with respect the first side engaged to the casing;

at least one filtering element operatively interposed between said suction opening and the collection container for holding, at the inside of said container, solid matter taken in through said inlet; said apparatus further comprising:

a support and movement platform carrying said suction unit;

at least one storage battery accommodated in corresponding seats provided in the platform;

power-driven movement means for moving said support platform and suction unit on a surface "S" to be cleaned;

control means acting on the power-driven movement means for selectively causing forward and backward movements and stopping and steering actions of the support platform and the suction unit on the surface "S" to be cleaned, wherein said suction unit is removably housed in a first seat defined in said platform, first and second contact elements being respectively carried by the suction unit and the platform for detachably connecting the suction unit with said at least one storage battery when the suction unit is housed in said first seat.

2. The apparatus according to claim 1, wherein said power-driven movement means (36, 37) comprises four electric movement motors (36) operatively connected to corresponding wheels (37) rotatably connected to said platform (12) and acting in rest relationship on the surface "S" to be cleaned, said movement motors (36) being selectively operable by an electronic control unit (35) driven by said control means (32, 33).

3. The apparatus as claimed in claim 2, wherein each of said wheels (37) comprises:

a disc-shaped support body (38) operatively engaged to the corresponding movement motor (36);

a plurality of rollers (39) circumferentially distributed about the rotation axis of said wheel (37) and rotatably engaged to the disc-shaped body (38) according to respective rotation axes oriented tangentially of a common circumference which is concentric with the disc-shaped body, each of said rollers (39) exhibiting a rolling surface (**39*a***) shaped according to a curved profile and acting in contact relationship on the surface "S".

4. The apparatus as claimed in claim 3, wherein the rollers (39) of each wheel (37) are distributed according to at least two parallel circumferential rows disposed row being circumferentially offset relative to the rollers belonging to the adjacent row.

5. The apparatus as claimed in claim 4, wherein said disc-shaped body (38) comprises a central portion (41) and lateral portions (42) coupled on laterally opposite sides of the central portion, pivot seatings (43) for said rollers (39) being defined between the central portion and each of said lateral portions.

6. The apparatus as claimed in claim 3, wherein the curved profile of the rolling surfaces (**39*a*) of rollers (39) has a bending radius equal to the distance between the rotation axis and the outer circumferential edge of the wheel (37**) defined by the rolling surfaces themselves.

7. The apparatus as claimed in claim 2, further comprising at least one pair of box-shaped support elements (45) , each of which operatively engages two of said wheels (37), said box-shaped support elements (45) being removably engaged to the opposite sides of said platform (12) for operatively securing the wheels (37) to the apparatus.

8. The apparatus as claimed in claim 7, wherein each of said wheels (37) operatively engages with each corresponding movement motor (36) by means of a coupling groove (44).

9. The apparatus as claimed in claim 7, wherein each of said box-shaped support elements (45) comprises a first and a second plate-like element (46, 47) detachably coupled together by restrained fixing and defining housing spaces (48) in which the respective wheels (37) are operatively engaged.

10. The apparatus as claimed in claim 1, further comprising at least one rotating brush (25) rotatably engaged to the platform (12) ahead of a front slit (28) provided on the platform itself, opening onto the surface to be cleaned "S" and communicating with the inlet (9) of the collection container (8).

11. The apparatus as claimed in claim 10, further comprising at least one auxiliary motor (27) operatively connected to the rotating brush by a driving belt (26).

12. The apparatus as claimed in claim 1, further comprising a closure cover (29) hinged to said platform (12) and disposed upon said suction unit (2), said closure cover (29) defining a rear aperture (31) through which the casing (3) of the suction unit is exposed outwardly.

13. The apparatus as claimed in claim 1, further comprising at least one lighting unit (51) mounted on said support platform and electrically connected to said storage battery to be activated upon command of photoelectric sensor (52) for lighting the surface "S" to be cleaned when the external environment brightness is lower than a predetermined limit.

14. The apparatus as claimed in claim 1, wherein said control means comprises a transmit unit (32) to be activated manually for sending drive signals (**32*a*), and at least one receive unit (33) operatively installed on the support platform (12) for operating said movement means (36, 37**) upon receipt of sand drive signals

15. The apparatus as claimed in claim 14, wherein said transmit and receive units (32 and 33) are designed to emit and receive radio pulses, respectively.

* * * * *

UNITED STATES PATENT AND TRADEMARK OFFICE

CERTIFICATE OF CORRECTION

PATENT NO. : 5,497,529

DATED : March 12, 1996

INVENTOR(S) : Boesi

It is certified that error appears in the above-indentified patent and that said Letters Patent is hereby corrected as shown below:

Column 8, line 10, after "disposed" insert --in side by side relation, the rollers of each--.

Column 8, Line 62, delete "sand" and insert --said--.

Column 8, Line 62, after "signals" insert --(32a)--.

Signed and Sealed this

Eighteenth Day of June, 1996

Bruce Lehman

*Attest:*

BRUCE LEHMAN

*Attesting Officer*

*Commissioner of Patents and Trademarks*